US006483051B2

(12) United States Patent
Määttäet al.

(10) Patent No.: US 6,483,051 B2
(45) Date of Patent: Nov. 19, 2002

(54) METHOD IN THE MANUFACTURE OF A KEYBOARD FOR AN ELECTRONIC DEVICE

(75) Inventors: Esa-Sakari Määttä, Tampere (FI); Marko Eromäki, Tampere (FI); Timo Tarvainen, Oulu (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/895,729

(22) Filed: Jun. 29, 2001

(65) Prior Publication Data

US 2002/0008008 A1 Jan. 24, 2002

(30) Foreign Application Priority Data

Jun. 30, 2000 (FI) ..... 20001555

(51) Int. Cl.[7] ..... H01H 13/70
(52) U.S. Cl. ..... 200/5 A; 29/622; 200/341
(58) Field of Search ..... 29/622; 200/5 A, 200/512, 516, 517, 341, 345; 379/433; 400/472, 490, 491.2, 495, 495.1

(56) References Cited

U.S. PATENT DOCUMENTS 4,057,710 A * 11/1977 Willmott ..... 200/345
4,839,474 A 6/1989 Hayes-Pankhurst et al. 200/5 A
5,020,215 A * 6/1991 Tsai ..... 29/622
5,066,357 A 11/1991 Smyth, Jr. et al. ..... 156/643
5,362,932 A * 11/1994 Inagaki et al. ..... 200/341
5,635,927 A * 6/1997 Lin ..... 200/311
5,669,979 A 9/1997 Elliott et al. ..... 134/1
5,717,429 A 2/1998 Coulon et al. ..... 345/168
5,812,116 A 9/1998 Malhi ..... 345/168
5,881,866 A 3/1999 Miyajima et al. ..... 200/513
6,008,468 A 12/1999 Tanaka et al. ..... 219/121.71
6,084,190 A * 7/2000 Kenmochi ..... 200/341
6,178,619 B1 * 2/2001 Tai ..... 29/622
6,196,738 B1 * 3/2001 Shimizu et al. ..... 200/314

* cited by examiner

*Primary Examiner*—Michael Friedhofer
(74) *Attorney, Agent, or Firm*—Perman & Green, LLP

(57) ABSTRACT

A method in the manufacture of a keyboard for an electronic device, the keyboard comprising a set of separate key caps fitted next to each other for transferring pressings, wherein each key cap is further attached to a common base. In the method, the key caps are separated from a solid piece by laser cutting, the piece being simultaneously attached to said base in such a way that the pieces to be separated from the piece, of which each represents one of said key caps, remain attached to said base even after the cutting.

11 Claims, 5 Drawing Sheets

-PRIOR ART-

-PRIOR ART-

METHOD IN THE MANUFACTURE OF A KEYBOARD FOR AN ELECTRONIC DEVICE

BACKGROUND OF THE INVENTION

1. Field of the Invention

The present invention relates to a method in the manufacture of a keyboard for an electronic device. The invention also relates to an assembly for the manufacture of a keyboard for an electronic device.

2. Description of the Related Art

For storing various information, devices are available according to prior art, such as notepad computers, small hand-held computers, or PDA devices (Personal Digital Assistant). These devices can be used for storing e.g. calendar data, notes, address data, telephone numbers, or corresponding information entered by the user. The data are normally entered in these devices by means of a keyboard. Also wireless communication devices, such as mobile phones, comprise a keyboard an a display for storing or selecting telephone numbers. Known devices include Nokia 8110, 7110 and 6110 mobile phones. It is also known that devices are available which comprise a combination of two different user interfaces, for example the user interfaces of a mobile phone and a PDA device. One such known device is Nokia 9110 Communicator, whose first user interface is a PDA user interface and second interface is a CMT (Cellular Mobile Telephone) user interface for mobile station functions. The above-mentioned device comprises separate keyboards and displays for the different user interfaces in the opened and closed positions of the device, wherein the PDA user interface is on the inner surfaces of the two hinged housings of the device, and the CMT user interface is on the outer surface of one housing.

The size of PDA/CMT devices is particularly dependent on the thickness and size of the keyboard. A compact and light-weight structure is sought, wherein the device is easily portable. On the other hand, the different keys of the keyboard must travel accurately and give the user's finger a clear feel of the operation both upon pressing and releasing the key. The feel is transferred by a click of the key which can be felt and often also heard. The click and the feel are produced in a known way by means of dome-shaped or bossed structures when they move in a buckling way, with a varying force required for the compression. In practice, the keys must not be located too close to each other, and they must be sufficiently large to make pressing with a finger possible and to prevent the pressing of an adjacent key. In the known PDA/CMT device, the key caps are fixed to a key pad made of rubber and positioned on a circuit board inside the device. The lower surface of the pad is provided with metal domes for clicking and electrical short circuiting. By the dome, the key pad is provided with a bulge to which the key cap is fixed. The keys extend through holes made in the housing of the device, and the housing also constitutes a frame protecting the key pad and the circuit board. Alternatively, the key cap can be fixed by a conical collar, whose buckling upon pressing of the key gives a feel of operation. The lower surface of the key is provided with a conductive material for short circuiting.

However, the structure according to prior art involves the problem that the frame structure, the key dome and the key cap constitute a relatively thick structure. Another problem is that the size of the key caps cannot be increased, because the frame necks would become too thin or narrow in view of the manufacture and strength. The necks are formed between holes and openings made in the frame structure. For this reason, the size of the keys must be limited, and they must be placed at a distance from each other, which also limits the design of the whole structure. For reasons related to the manufacturing technique and without weakening the structure, the frame structure cannot be made thinner without a limit to make the profile lower.

Yet another particular problem in the placing of the key caps on the key pad is caused by the fact that the mutual positioning of the key caps, fitting them in the same position and precisely at a desired distance from each other is a manufacturing stage requiring particular accuracy. In addition to the technical problem, variations in positions and rotation of the key caps in relation to each other and their turning in relation of the device and the keyboard give a poor impression of the whole device. When the key caps are placed very close to each other, even slight displacements are easily visible. Changes in positions may cause collisions of closely placed keys. A matter requiring particular accuracy is the attachment of the key caps to the key dome, since variations in the point of attachment affect the user's feel of the keys, varying in a disturbing manner. It is difficult to position the key caps and the attachment precisely at the same point.

Keys of prior art are disclosed e.g. in U.S. patent publication Pat. No. 5,881,866 presenting key domes contained in a key pad and a key cap pressing the same by means of an actuator and being attached to the key pad at its edge portions. Also in this case, it is difficult to attach different keys always in the same position. One solution for the thickness of the keyboard of an electronic device, particularly a portable computer, is solved in U.S. patent publication Pat. No. 5,812,116, in which the attachment of the key caps is still high and difficult to assemble. Another keyboard construction is presented in U.S. patent publication Pat. No. 5,717,429, in which separate key caps are attached to a means corresponding to a key dome. One keyboard structure for an electronic device is also shown in U.S. patent publication Pat. No. 4,839,474, in which the key caps are fixed to a key pad by means of a flexible neck. The feel of the key is different when compared with a key dome.

SUMMARY OF THE INVENTION

It is an aim of the present invention to provide an improvement to the prior art; in particular, the aim is to achieve a compact keyboard with thin dimensions for an electronic device. The aim is to considerably facilitate the assembly and manufacture of the keyboard. The aim is to eliminate particularly the above-mentioned problems related to controlling the position and attachment of the key caps.

With the invention, considerable advantages are achieved particularly in the manufacture, which will become considerably easier. The need for a separate frame structure is eliminated, wherein the structure of the keyboard becomes lower, which makes thinner devices possible.

The device is particularly a PDA/CMT device, wherein the keyboard of the invention can be fitted between its two housings which can be closed and opened. The invention can be applied in the keyboards of both the PDA and the CMT user interfaces. A particular advantage is achieved in that the keyboard can be easily installed and replaced, wherein the installation of various keyboard versions is possible without replacing the housings or frame structures. Furthermore, the connection of the keyboard assembly to the device can be deferred to the final stage of production, which will facilitate the manufacture of different versions.

A particular advantage is achieved in that the assembly of single key caps is avoided, wherein position and attachment errors are considerably reduced and even totally eliminated. After this, it is no longer necessary to manufacture single, separate key caps for separate installation. Thanks to the method, the same uniform feel can be obtained for all the keys of the keyboard. The manufacturing technique also has the advantage that when blanks of the same assembly are used, it is easy to form different, even single configurations for keys by cutting. It is obvious that when the method is used, it is particularly easy to implement modifications in the design of the key caps. The whole space between the key caps is available for even large cap structures, wherein no frame structures need to be placed therebetween. By means of the method, the spaces are formed precisely according to the desired dimensions.

The invention is based on the idea that a key pad used as a uniform base is first connected with a uniform plate-like piece in which separate key switches, more precisely their key caps, are formed first after this by cutting. The parts to be cut off from the piece represent the key caps, and these parts remain, even when cut, attached to their base, wherein the installation of separate caps is avoided. The invention is also based on the idea that the cutting is performed by precise laser cutting by removing the material layer by layer. In this connection, so-called ablation is applied to improve the cutting result, to avoid drawbacks caused by heating and melting of the material during the cutting. The energy of the laser beam is only used to cause breaking of molecule bonds. To accelerate the cutting, the key caps are preferably placed very close to each other, wherein the quantity of the material to be removed is considerably reduced and the spaces do not need to be covered by other structures. In the method, the material can be removed in cut pieces, wherein also in this case e.g. a frame structure can be placed between the key caps, if necessary.

It should be noted that the presented laser apparatuses are known as such from other uses. For example, U.S. patent publication Pat. No. 6,008,468 should be mentioned, in which also a mask arrangement is used for manufacturing net-like pieces. Furthermore, U.S. patent publication Pat. No. 5,066,357 is known, in which laser cutting is applied to form circuits on a substrate. In laser cutting, the beam energy, scanning rate, scanning times, radiation wavelength, scanning frequency, the thickness of the material layer to be removed, and other functional parameters used for each material and for the desired final result are thus prior art known by anyone skilled in the art, in which also normal experimental and test runs can be applied for comparison and testing. Yet another example of a known laser apparatus for cleaning the surface of the substrate is presented in U.S. patent publication Pat. No. 5,669,979.

BRIEF DESCRIPTION OF THE DRAWINGS

In the following, the invention will be described in more detail by using as an example an advantageous embodiment and particularly a PDA/CMT electronic device comprising two user interfaces. It is obvious that the invention can also be applied in other devices within the scope of the claims to achieve the above-mentioned advantages. Reference is made to the appended drawings, in which:

DETAILED DESCRIPTION OF THE INVENTION

Figure 1:
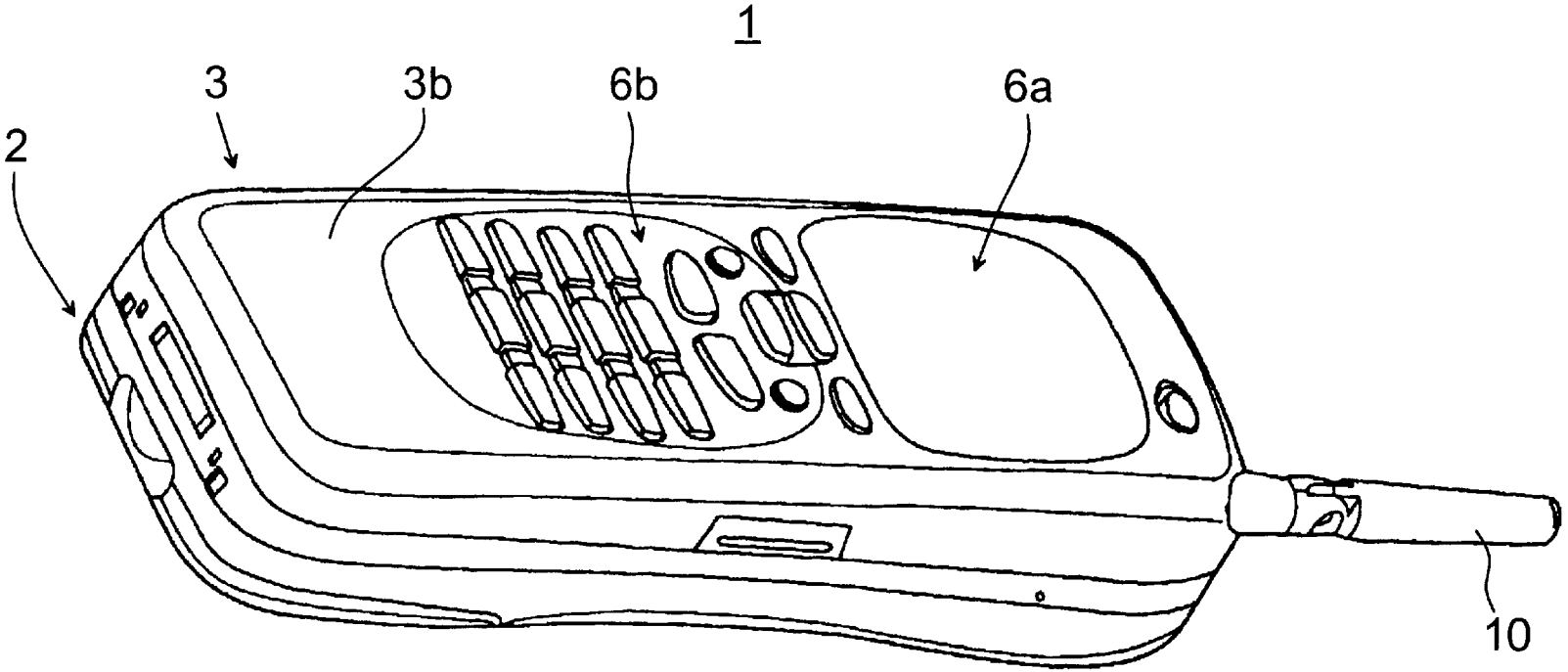
FIG. 1 shows an electronic device according to prior art, particularly a PDA/CMT device shown in a closed position and in a perspective view.
Figure 2:
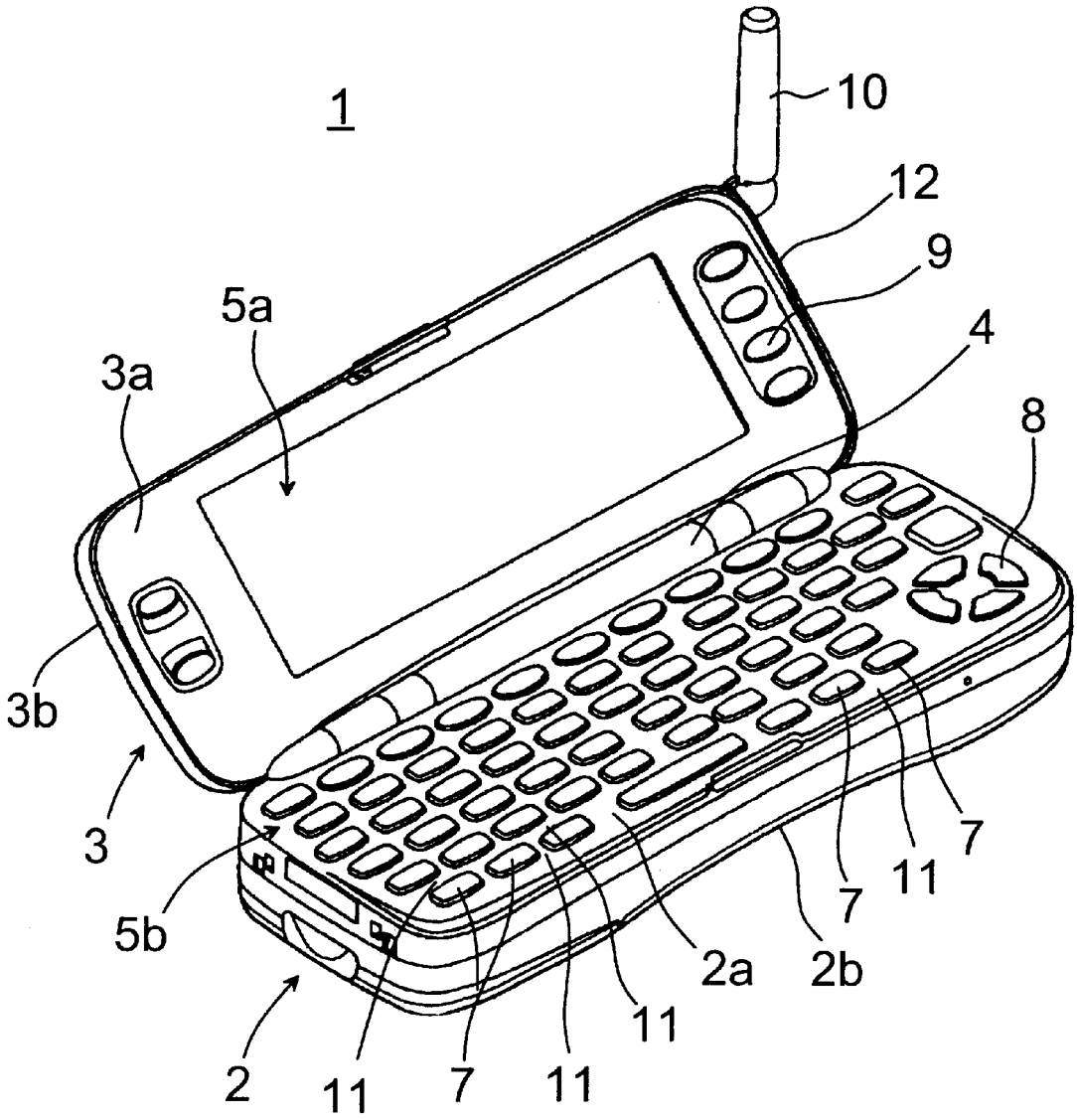
FIG. 2 shows the device of FIG. 1 in an opened position and in a perspective view.

With reference to FIGS. 1 and 2, a wireless communication device 1 according to the invention, i.e. an electronic device 1, comprises a first housing 2 comprising at least an inner surface 2*a* and an outer surface 2*b*, as well as a second housing 3 comprising at least an inner surface 3*a* and an outer surface 3*b*. Further, the device 1 comprises hinge means for moving the first housing 2 and the second housing 3 to a closed position S according to FIG. 1, in which position the inner surface 2*a* of the first housing 2 and the inner surface 3*a* of the second housing 3 are against each other, as well as an opened position A according to FIG. 2, in which position the inner surface 2*a* of the first housing 2 and the inner surface 3*a* of the second housing are exposed. The device 1 also comprises first input and display means 5*a*–5*b* for a first user interface (UI), the means 5*a*–5*b* being provided on the inner surface 2*a* of the first housing 2 and on the inner surface 3*a* of the second housing 3, and second input and display means 6*a*–6*b* for a second user interface, separate from the first input and display means 5*a*–5*b*, the means 6*a*–6*b* being provided on the outer surface 3*b* of the second housing 3.

The first user interface of the device 1 is a PDA user interface, and the second user interface is a CMT user interface. The first input and display means 5*a*–5*b* for the first user interface in the wireless communication device 1 comprise a keyboard element 5*b* placed on the inner surface 2*a* of the first housing 2 and a display element 5*a* placed on the inner surface 3*a* of the second housing 3. Furthermore, the input and display means 6*a*–6*b* for the second user interface in the wireless communication device 1 comprise a keyboard element 6*b* and a display element 6*a* placed on the outer surface 3*b* of the second housing 3. In the wireless communication device 1 shown in FIG. 2, the keyboard element 5*b* also comprises keys 8 for shifting the cursor on the display of the display element 5*a* to the left, to the right, up and down, and the display element 5*a* also comprises keys 9 placed next to the display element 5*b* for selecting control functions from menus displayed on the display of the display element 5*a*. The wireless communication device 1 also comprises an antenna 10.

The inner surface 2*a* consists of a separate, rigid frame structure provided with openings in which separate keys 7 are placed, and of them, the key caps are visible, with their upper surfaces provided with printed number and letter symbols for indicating the function. The key pad is protected under the frame. Between the keys 7 are also placed the necks 11 of the frame separating the keys from each other. The presented structure increases the thickness of the device 1 also in that the keys 7 and 8 are elevated from the inner surface 2*a*. Thus, the housing 3 is provided with a collar 12 elevated from the inner surface 3*a* so that the inner surface 3*a* would not collide with the keys and the device 1 could be closed tightly.

Figure 3:
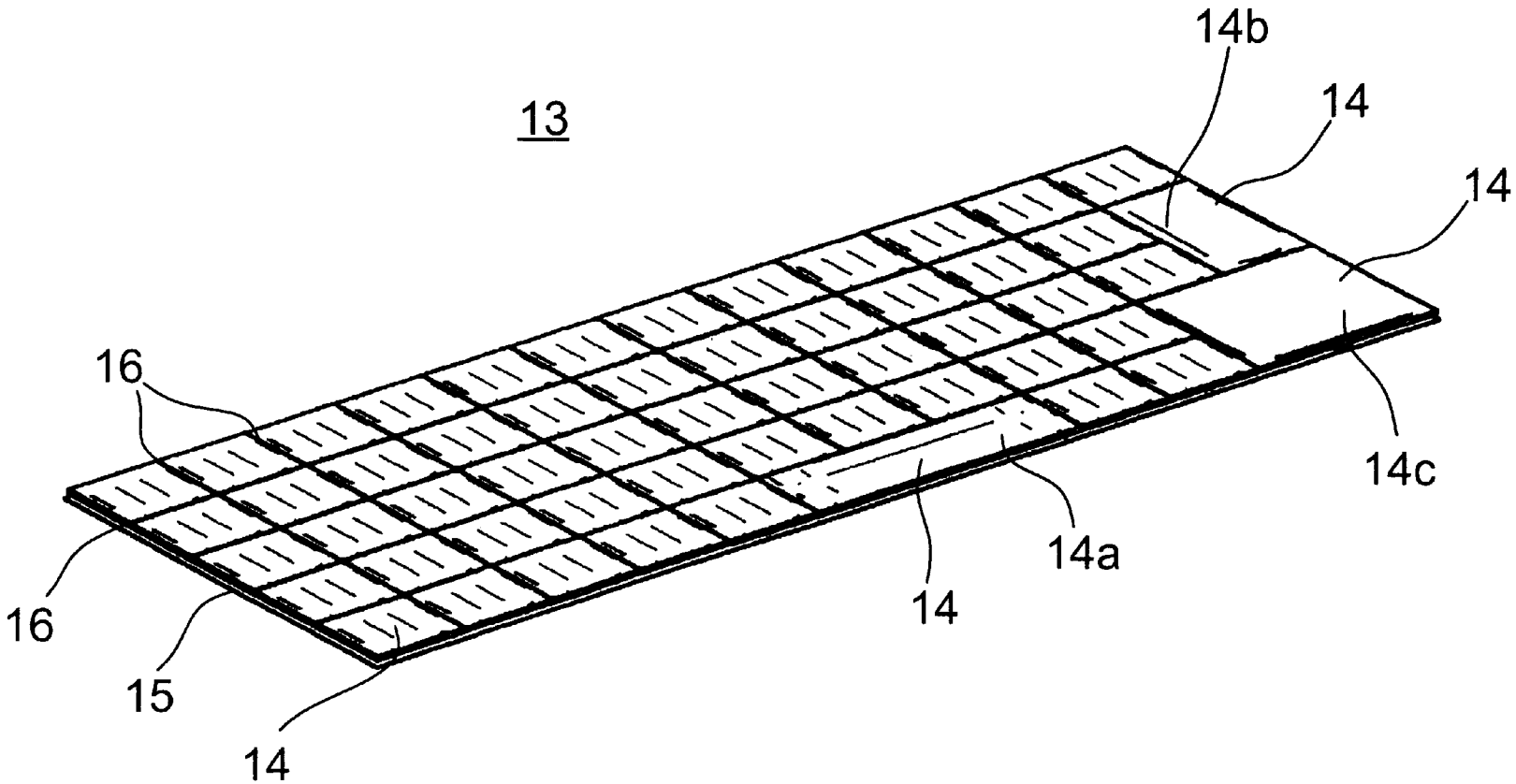
FIG. 3 shows a keyboard according to an advantageous embodiment of the invention in a perspective view.

FIG. 3 shows a keyboard 13 manufactured by the method according to the invention, comprising a set of keys 14 placed next to each other. The keys 14 are attached to key domes formed in a solid key pad 15. In the attachment, it is possible to utilize e.g. laser welding, ultrasonic welding, glueing, or another method known as such and selected on the basis of the materials available and the applicability of the manufacturing apparatuses. The key domes are formed in the key pad 15 by thermoforming.

The top surface of the keys 14 are also marked with number and letter symbols, and the keyboard partly corresponds in its order the QWERTY keyboard of a computer, comprising e.g. an ENTER key 14*a*, a SPACE key 14*b*, as well as an integrated rocker button 14*c* for moving the cursor. In the presented embodiment, the keys 14 are rectangular and have a size of about 9.4×9.4 mm, and the whole keyboard 13 forms a rectangular, two-layer structure having a height of only about 1.4 mm. The key pad 15 is a solid piece covering the whole keyboard 13. The spaces 16 between the keys 14 can be arranged to be very narrow, having a width of only 0.1 mm in the presented embodiment. The keyboard 13 of FIG. 3 is arranged to be installed and attached, in an electronic device 1 corresponding to FIG. 1, to a location in which there is the key element 5*b* in FIG. 1. The thickness of the closed device 1 can thus be reduced.

According to the invention, the keys 14, more precisely their key caps, are formed in a planar, solid board, covering the whole keyboard 13 and made of a plastic material, by thermoforming. The thickness of the board is about 0.5 mm. Thus, desired shapes can be formed on the upper and lower surface of the key 14, e.g. to give a more pleasant feel and for reasons of the appearance. The shapes also affect the total height of the key 14. After this, said board is attached to the tops of the key domes of the keyboard pad 15, normally centrally at each of the designed key 14. First after this, the different keys 14 are separated from the board; more precisely, the single key caps which are visible in FIG. 3 are separated from the board. The separation takes place by cutting the board only but not the key pad 15, preferably by laser cutting. According to the invention, laser devices are utilized here which are known as such and which include a so-called Excimer Laser Beam device or a UV Yag Laser Beam device based on light at ultraviolet wavelength. In both cases, the cutting is based on so-called ablation.

In the ablation laser cutting of the method, the material is removed layer by layer, only a few micromillimeters at a time. In the method according to the invention, and with the Excimer Laser Beam device, a so-called exposure mask is used, which is for example a plate of metal provided with openings forming a pattern that is to be cut. The laser beam is flashed, and through the openings, the radiation energy can affect the material to be cut. The flash takes a fraction of a second, and the radiation energy breaks the bonds between the molecular structure of the plastic material in the keyboard, and no melting of the material will take place. The accuracy of the method is considerable, and flashes are executed until a required thickness of the material has been cut, wherein cutting of the key pad underneath is avoided. Using a UV Yag Laser Beam device, the material is removed layer by layer with a thin laser beam scanning along a desired path which follows the areas to be cut, e.g. spaces between the keys. It is thus easy to cut parts to be totally separate from each other.

Figure 4:
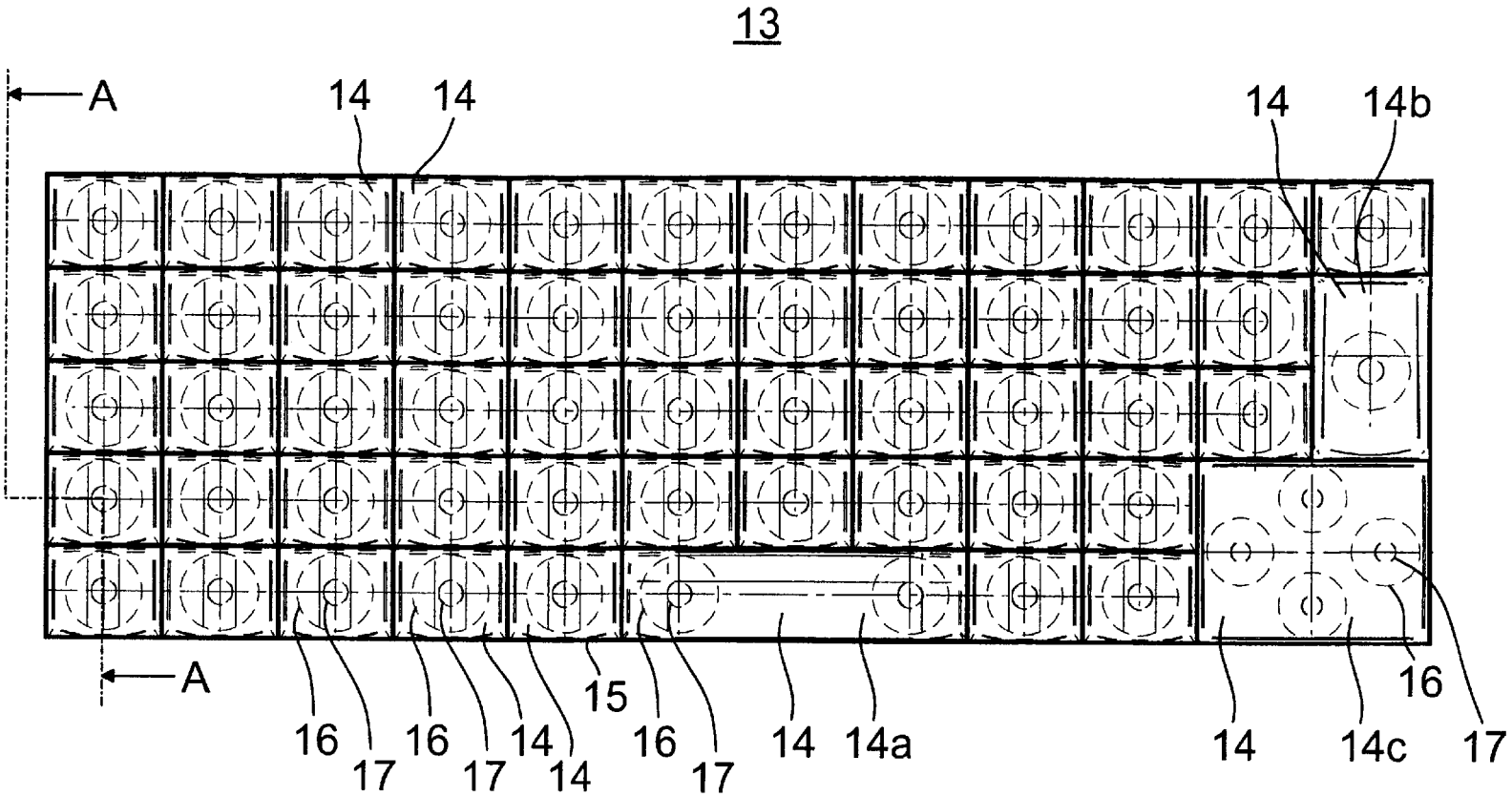
FIG. 4 shows a keyboard according to FIG. 3 seen from above.

FIG. 4 shows the keyboard 13 of FIG. 3 with its separate keys 14, of which the key caps are visible. The reference numerals correspond to the reference numerals of FIG. 3. A key pad 15 placed underneath the keys 14 and used as a base is provided with key domes 16 whose locations are illustrated by broken lines. A SPACE key 14*a* comprises two key domes 16 having the same function, and the rocker key 14*c* comprises four key domes 16 for moving the cursor in vertical and lateral directions. The key domes 16 are arranged as a matrix on the pad 15. The circular key domes 16 do not extend underneath the adjacent key 14, to prevent pressings by mistake. In the presented embodiment, the key domes 16 remain completely underneath the key cap. The convex side of the key dome is placed against the key cap. Pressing of the key cap presses down the dome in a flexible and returnable manner. For this purpose, the dome is made in a way known as such. The concave side of the dome is provided with an electro-conductive coating or piece which produces short-circuiting of electrical contacts. The contacts are formed on a flexible or rigid circuit board which is placed on the concave side of the key domes, underneath the pad. Said circuit board has preferably the size of the key pad and comprises contacts for several keys. By means of the short circuiting, the electronic device can detect, in a way known as such, which key is pressed down.

Figure 5:
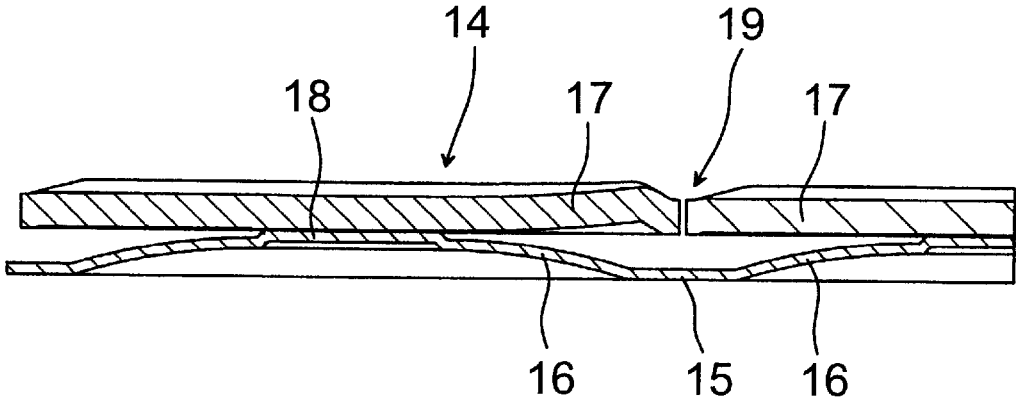
FIG. 5 shows a section of the keyboard of FIG. 3 at point A—A in a side view.

FIG. 5 shows the structure of the key pad 15, one key dome 16 and one key cap 17 in more detail, wherein they constitute a key 14. The key dome 16 comprises, as an integrated structure, an actuator 18 which transmits the pressing to the dome 16 and produces a better, desired clicking response. The response is more accurate than without the actuator. The actuator 18 and its position are illustrated by a broken line in FIG. 4. If the key cap 17 is directly attached to the dome 16, the key cap 17 must be designed to correspond to the dome 16 at the point of attachment. According to one example, the cap 17 is fixed to the dome 16 by means of a centrally positioned annular collar. Further, with reference to FIG. 5, the actuator 18 can also be a separate pellet-like flat part which is fixed to the dome 16 or the cap 17. Fixing of a separate actuator requires a separate working stage, and particularly its accurate positioning is difficult. The actuator is thus preferably integrated in the dome 16. In this case, there are fewer fixing points, and the above-mentioned problems which are also due to variations in the fixing point of the actuator are avoided. Variations in the position of a separate actuator also change the position of the cap 17.

The circular, discoidal actuator 18 has a diameter smaller than the dome 16, and it is formed as an even bulge on the top surface of the dome 16. The cap 17 is attached to the top surface of the actuator 18. At this stage, the set of key caps 17 still constitute a uniform plate-like structure, and first after this, the caps 17 are entirely separated from each other, at point 19 between them. The removal of the material is started from the top surface of the key cap board, to which the laser beam has access, and material is removed layer by layer, until the material board has been penetrated. Cutting is stopped at this stage, wherein the pad 15 is not cut. Thus, the space 19 can be formed very narrow. It is obvious that the space 19 can also be made larger, by removing a material strip cut off.

In the above-described advantageous embodiment, the dome is first attached directly to the piece from which the key caps are separated by cutting. The dome can also be formed of a metal bell fitted underneath a sheet formed of a film. The actuator is preferably fitted between the bell and the film, or it is integrated in the metal bell. Thus, the structure of the metal bell corresponds to the actuator 18 of the key dome 16 of FIG. 6, formed on top of the metal bell for example by pressing. These separate parts constitute said key pad. The key cap is attached onto the film, on the top formed by the bell. Said uniform sheet-like film, large key pad with its domes, flexible rubber mat or film on which the bells are attached and which are provided with a design allowing the movement of the key cap, constitute a joint fixing base for a set of key caps. Said set comprises at least some of the key caps of the whole keyboard.

Said base and piece forming the caps are substantially parallel or substantially equal in size. The key caps are in a uniform piece which, in accordance with the invention, is cut to separate the key caps from each other first after the fixing. In its simplest form, the piece is a flat plate with a uniform thickness, fixed on said base and representing a set of key caps joined at their edges. The final shape, configuration and distance of the caps are first determined in connection with the cutting. The edge surface surrounding the key cap is formed upon cutting, when a laser beam is used to cut the plate from above and from a substantially perpendicular direction. The assembly also contains an intermediate film to be fitted underneath the film, provided with openings at the bells, wherein a metal bell can form a short circuit on the circuit board placed lowermost.

It is obvious that the final assembly of the keyboard will vary. The assembly varies also during the assembly, when the uniform, uncut piece formed by the key caps is fixed to it. According to the invention, said piece is fixed to the final position at least in the sense that separate key caps no longer need to be removed, nor their mutual position be changed.

The invention has been described above when applied in connection with an advantageous wireless communication device, but on the basis of the description, it will be obvious for anyone skilled in the art that the invention can also be applied in connection with other electronic devices within the scope of the invention.

What is claimed is:

1. A method for manufacturing a keyboard for an electronic device, the keyboard comprising a set of separate key caps fitted next to each other for transferring pressings, the method comprising the steps of:

attaching a solid piece to a common base, the solid piece including a plurality of key caps;

separating the solid piece into individual key caps, each key cap being separated from the solid piece by laser cutting;

wherein after separating the solid piece into the individual key caps, the key caps remain attached to the base even after the cutting.

2. A method according to claim 1, wherein the solid piece comprises a uniform upper surface which seamlessly covers a top surface of each of the key caps, and a uniform lower surface which seamlessly covers a lower surface of each of the key caps, and wherein in the method, an edge surface surrounding each of the key caps is formed by the laser cutting.

3. A method according to claim 1, wherein said base comprises a key pad fitted underneath the key caps, and at least one key dome is provided underneath each key cap on the key pad.

4. A method according to claim 3, wherein a metal bell is provided underneath each key dome and a bulge used as an actuator is formed on top of said metal bell.

5. A method according to claim 3, wherein said base comprises a uniform sheet-like piece in which each key dome is seamlessly integrated, and a top of each key dome is provided with a bulge used as an actuator, seamlessly integrated in the key dome.

6. A method according to claim 5, wherein each of said key caps is directly attached to the actuator of each key dome.

7. A method according to claim 3, wherein said base also comprises a film fitted between said key pad and said key caps, said key caps being attached to the film.

8. A method according to claim 3, wherein each of said key caps is directly attached to each key dome.

9. The method according to claim 3 wherein the top of each key dome is provided with a separate discoidal part used as an actuator.

10. An assembly for the manufacture of a keyboard for an electronic device, the keyboard comprising a set of separate key caps fitted next to each other for transferring pressings, wherein each key cap is further attached to a common base, and wherein each of the separate key caps are formed by laser cutting a solid piece of the assembly, the solid piece comprising a plurality of key caps, the solid piece being attached to the common base so that when each key cap is separated from the solid piece, each key cap remains attached to the base even after the cutting.

11. An assembly according to claim 10, wherein said solid piece comprises a uniform upper surface which seamlessly covers a top surface of each of the key caps, and a uniform lower surface which seamlessly covers a lower surface of each of the key caps, and an edge surface surrounding each key cap is formed in connection with said laser cutting of the solid piece.

* * * * *